US007021806B2

(12) United States Patent
Ovenshire

(10) Patent No.: US 7,021,806 B2
(45) Date of Patent: Apr. 4, 2006

(54) ILLUMINATED DISPLAYS

(75) Inventor: Jay H. Ovenshire, Macomb Township, MI (US)

(73) Assignee: General Motors Corporation, Detroit, MI (US)

( * ) Notice: Subject to any disclaimer, the term of this patent is extended or adjusted under 35 U.S.C. 154(b) by 103 days.

(21) Appl. No.: 10/852,425

(22) Filed: May 24, 2004

(65) Prior Publication Data

US 2005/0259425 A1 Nov. 24, 2005

(51) Int. Cl.
*F21V 7/00* (2006.01)

(52) U.S. Cl. ..... 362/527; 362/300; 362/301; 362/302; 362/304; 362/806; 40/556

(58) Field of Classification Search ..... 362/304, 362/300, 517, 297, 298, 301, 302, 303, 305, 362/346, 806, 812; 40/556
See application file for complete search history.

(56) References Cited

U.S. PATENT DOCUMENTS 3,395,272 A * 7/1968 Nicholl ..... 362/305
3,835,342 A * 9/1974 Freeman ..... 313/114
4,302,801 A * 11/1981 Duddy ..... 362/345
4,635,170 A * 1/1987 Beiswenger ..... 362/157
4,635,171 A * 1/1987 Beiswenger ..... 362/187

* cited by examiner

*Primary Examiner*—Thomas M. Sember
(74) *Attorney, Agent, or Firm*—Laura C. Hargitt

(57) ABSTRACT

An illuminated display includes a light source positioned within an optical chamber defined by a first optical element having a first reflective surface with an image thereon. A second optical element is positioned within the chamber and is spaced from the first optical element to define a gap therebetween, through which gap the image is visible. The second optical element has a second reflective surface thereon for reflecting light from the light source onto the image. A third reflective surface is positioned on the first optical element and also reflects light from the light source to the second reflective surface from which light is directed to the image on the first optical element and out through the gap. In this way the efficiencies of the illuminated display are enhanced. The illuminated display is used in combination with an automotive vehicle to display branding information and logos.

16 Claims, 3 Drawing Sheets

ILLUMINATED DISPLAYS

FIELD OF THE INVENTION

The present is related to illuminated displays. More particularly, the present invention is related to illuminated displays for displaying logos, brands or other information on or in automotive vehicles.

BACKGROUND OF THE INVENTION

In the automotive industry it is important that vehicle models be readily identifiable by other drivers, passengers and pedestrians so that the public is aware that the vehicle models have been purchased. It is important that brands or logos be displayed in prominent, attractive ways and that brands and logos be visible at night. Currently, most brand and logo indicia are illuminated by reflection of light from other sources such as vehicle headlights and street lights that illuminate an entire vehicle and thus do not necessarily emphasize just brand information or logos related to the vehicle.

There is currently a need on automotive vehicles for illuminated displays that reliably and clearly exhibit information, such as branding information and logos.

SUMMARY OF THE INVENTION

The present invention is directed to an illuminated display comprising a light source for emitting light waves and first and second optical elements positioned adjacent the light source. The first optical element includes a first reflector having indicia thereon wherein the first reflector reflects and absorbs components of the light waves that illuminate the indicia. The second optical element blocks a portion of the light waves and is spaced from the first optical element to define a gap therebetween, through which gap the indicia on the first reflector is visible. The second optical element has at least a second reflector thereon which is positioned to reflect light waves from the light source onto the first reflector having the indicia thereon.

In another aspect of the invention the illuminated display includes a third reflector on the first optical element, which third reflector reflects light waves from the light source onto the second reflector, which second reflector in turn reflects the light waves onto the first reflector having the indicia thereon.

In another aspect of the invention the second optical element has an aperture which passes light waves therethrough.

In another aspect of the invention, the first, second and third reflectors are concentric about an axis.

In another aspect of the invention at least the second reflector has a parabolic reflective surface.

In additional aspects of the invention the light source is an incandescent bulb, a light emitting diode, an optical fiber or a fluorescent bulb.

In further aspects of the invention, the optical elements are pologonal with many sides, triangular, square, rectangular, circular, oval or any other shape with which the principles of the present invention are compatible.

In still a further aspect of the invention, the illuminated display is incorporated in a rear on front signal lamp arrangement and may also be configured as a taillight, a turn signal light, a turn signal light, a brake light, a back-up and stop light, a day time running light or a parking light.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

Figure 1:
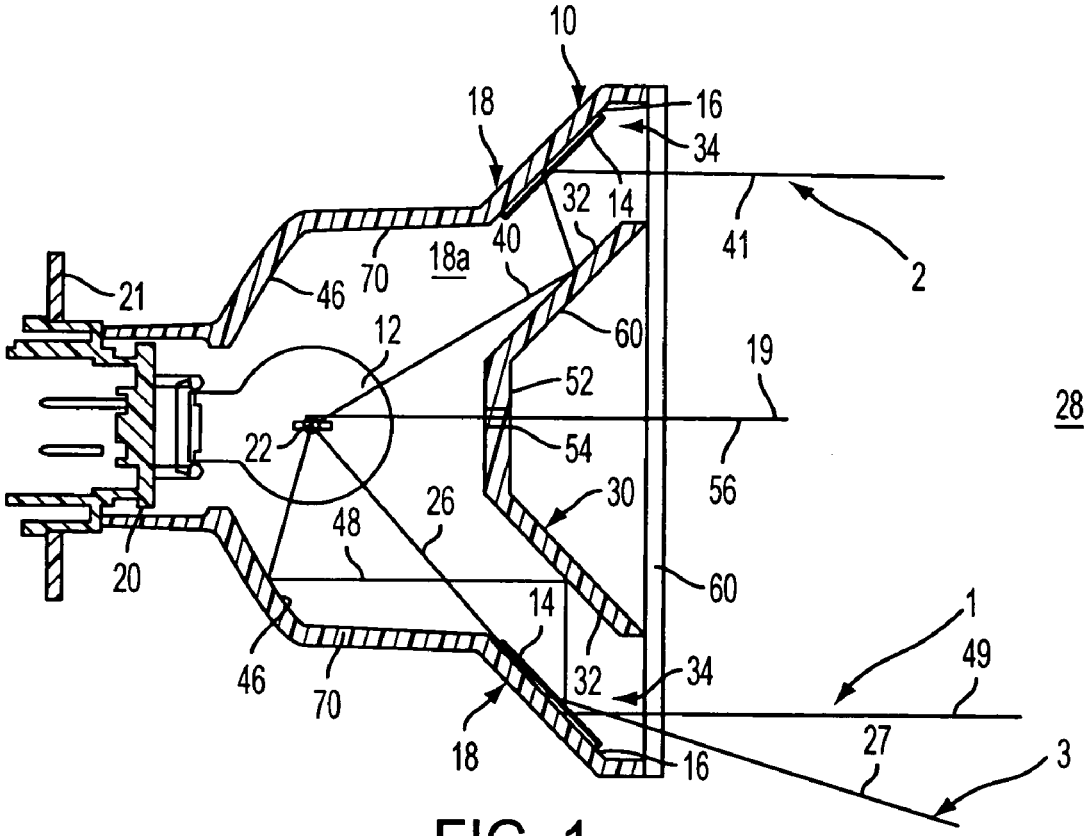
FIG. 1 is a side elevation of an illuminated display configured in accordance with the principles of the present invention.

Referring now to FIG. 1 there is shown an illuminated display 10 which utilizes a light source in the form of an incandescent bulb 12 to illuminate an image 14 placed on a reflective surface 16 of a first optical element 18. The first optical element 18 defines an optical chamber 18*a* disposed around an axis 19. The incandescent bulb 12 is mounted on a lamp base 20 that in the illustrated embodiment is mounted on a schematically illustrated support 21 in an automotive vehicle. While an incandescent bulb 12 is illustrated, the lighting source may be any satisfactory lighting source 20 such as, but not limited to, a light emitting diode, a fluorescent bulb, or an optical fiber source.

The bulb 12 has a filament 22 which emits light waves 26 which directly impinge and reflect from the image 14 on the reflective surface 16 of the first optical element 18 so as to be visible as light waves 27 in the space 28 beyond the optical display 10. A second optical element 30 having a second reflective surface 32 is spaced by a gap 34 from the first reflective surface 16. When light waves 40 from the filament 22 reflect from the surface 32, they are directed toward the image 14 on the first reflective surface 16 and are reflected outwardly therefrom as light waves 41 which are visible in the space 28 beyond the illuminated display 10.

In addition to the first reflective surface 16 with the image 14 thereon, the first optical element 18 has a third optical surface 46 positioned laterally with respect to filament 18 for reflecting light waves 48 onto the second reflector 32 on the second optical element 30. The light waves 48 are then reflected from the second reflector 32 onto the image 14 on the first optical surface 16, and reflected out of the illuminated display 10 through the gap 34 as reflected light waves 49 visible in the space 28.

The image 14 has not only the direct reflection 27 visible in the space 28, but also the indirect reflections 41 and 49 illuminated by light initially reflected from the second reflector 32 visible in the space 28. Consequently, a substantial portion of the light waves emitted from the filament 22 of the incandescent lamp 12 are utilized to illuminate the image 14. This results in very high lighting efficiencies that brightly illuminate the image 14. The image 14 will absorb some components of the light beams 26, 40 and 48 and reflect other components thereby conveying information incorporated in the image. In a preferred application of the illuminated display 10, the information in the image includes brands, trademarks or logos identifying of the automotive vehicle with which the illuminated display is associated.

The second optical element 30 has a center panel portion 52 which in a preferred embodiment of the invention extends normal to the axis 19 of the illuminated display 10. The flat plate portion 52 optionally has an aperture 54 therethrough aligned with the axis 19 which passes a light beam 56 therethrough, which light beam 56 is visible in the space 28.

Preferably, the third reflective surface 46 is a parabolic surface, while the reflective surfaces 16 on the first optical element 18 and the surfaces 32 on the second optical element 30 have optical curvatures which vary up to about 20% in order to tune the image 14 reflected from the display 10. Moreover, since there are at least two and preferably three reflections from the image 14, the image has an opportunity to take advantage of superimposed reflections to enhance a composite image as viewed from the space 28.

A connection portion 70 of the first optical element 18 extends between reflective surfaces 16 and 46 of the first optical element 18 and positions the image 14 with respect to the light bulb 12 and with respect to the second and third reflective surfaces 32 and 46. The connecting portion also directs, or may direct, additional light waves onto the reflective surface 32 of the second reflector 30. Typically, the illuminated display 10 is covered by a transparent plastic lens 60 which may be tinted or untinted.

Figure 2:
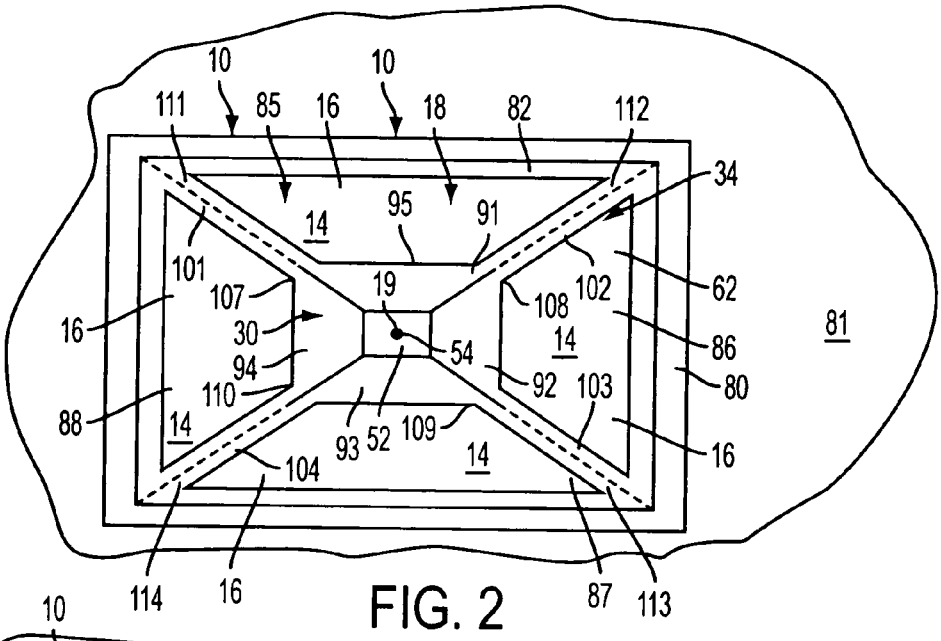
FIG. 2 is a front planar view of one embodiment the illuminated display of FIG. 1.

Referring now to FIG. 2 there is shown a first embodiment of the illuminated display 10 shown in FIG. 1, wherein the illuminated display is rectangular (or square) in shape. In the first embodiment, the first optical element 18 has a periphery 82 and is comprised of four trapezoidal sections 85, 86, 87 and 88 with reflective surfaces 16 thereon containing the image 14.

The second optical element 30 of the first embodiment is surrounded by the first optical element 18 and is also rectangular or square having trapezoidal panel sections 91, 92, 93 and 94 that converge from a perimeter 95 to the square or rectangular bottom wall 52. As with FIG. 1, the central panel portion 52 optionally has at least one aperture 54 therethrough for passing light waves from the incandescent bulb 12 (FIG. 1) out into the space 28, preferably along the axis 19. As is seen in FIG. 3, the image 14 appears in the gap 34 between the perimeter 82 of the first optical element 18 and the perimeter 95 of second optical element 30.

Figure 3:
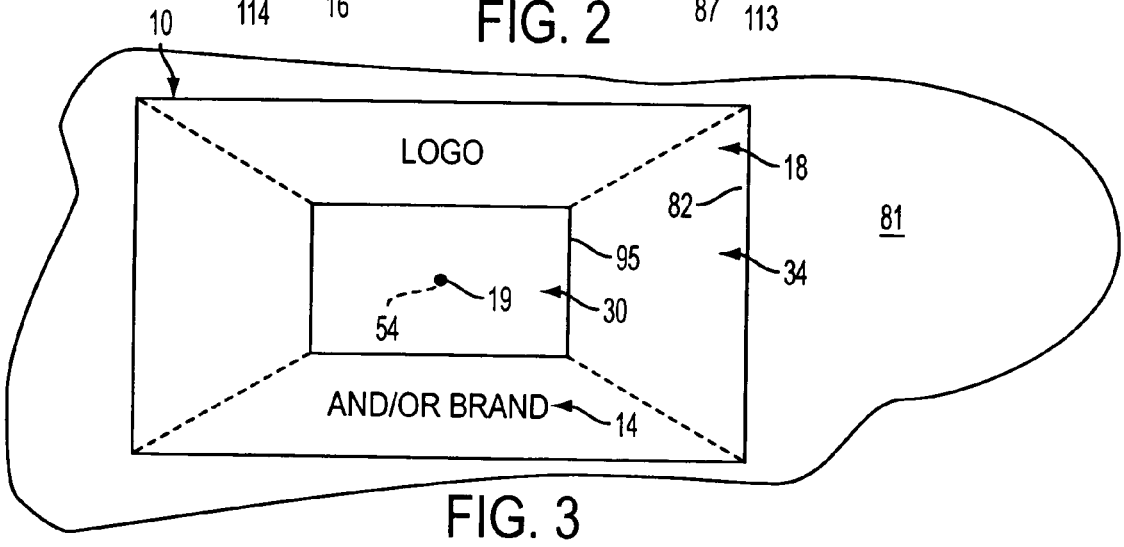
FIG. 3 is a planar view of an image created by the illuminated display of FIGS. 1 and 2.

In the embodiment of FIGS. 1–3, the second optical element 30 is supported within the first optical element 18 by four preferably transparent struts 101–104 which extend through the gap 34 from exterior corners 107–110 of the second optical element to interior corners 111–114 of the first optical element. Preferably, the struts 101–104 are transparent plastic and are molded unitarily with the first and second optical elements 18 and 30, the image 14 being aluminized onto the surface 16 of the first optical element. In an alternative embodiment, the second optical element 30 is adhered to a transparent cover plate such as the lens 60 of FIG. 1 which is attached at the periphery 82 of the illuminated display 10 to support the secondary optical element in spaced relation to the first optical element 18.

Figure 4:
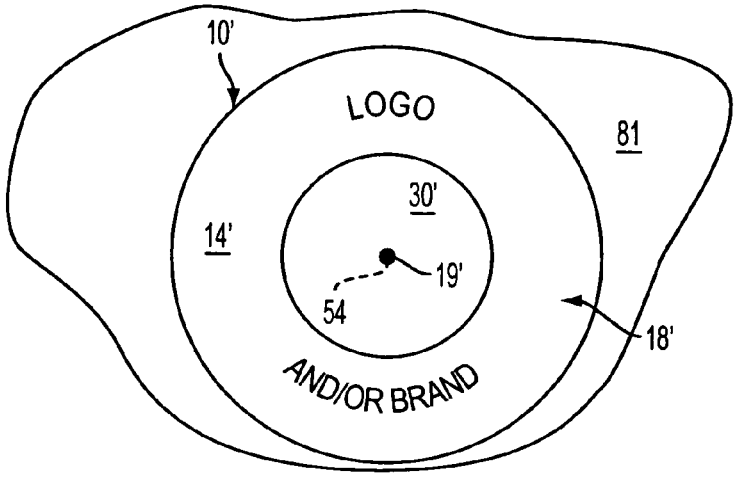
FIG. 4 is a planar view of an illuminated image created by a second embodiment of the display of FIG. 1.

FIG. 4 illustrates a second embodiment of the invention in which illuminated display 10' is circular and in which the image 14' is annular due to the annular space 34' created by circular first and second optical elements 18' and 30'. While a circular illuminated display 10' is shown, the display 10' can also be oval or have inner and outer perimeters defined by arcuate lines of various configurations, as long as the resulting shapes are compatible with the principles of the present invention. It is to be recognized that the shape of the illuminated display 10 can be triangular, polygonal with more than four sides, a combination of shapes or may be of any shape compatible with the principles of the present invention. When the illuminated display 10 is made in other shapes, the second optical element 30 thereof is supported either by arrangements of struts as exemplified by the struts 101–104 in FIG. 2, or by attachment to a transparent front lens such as the plastic lens 60 of FIG. 1.

Figure 5:
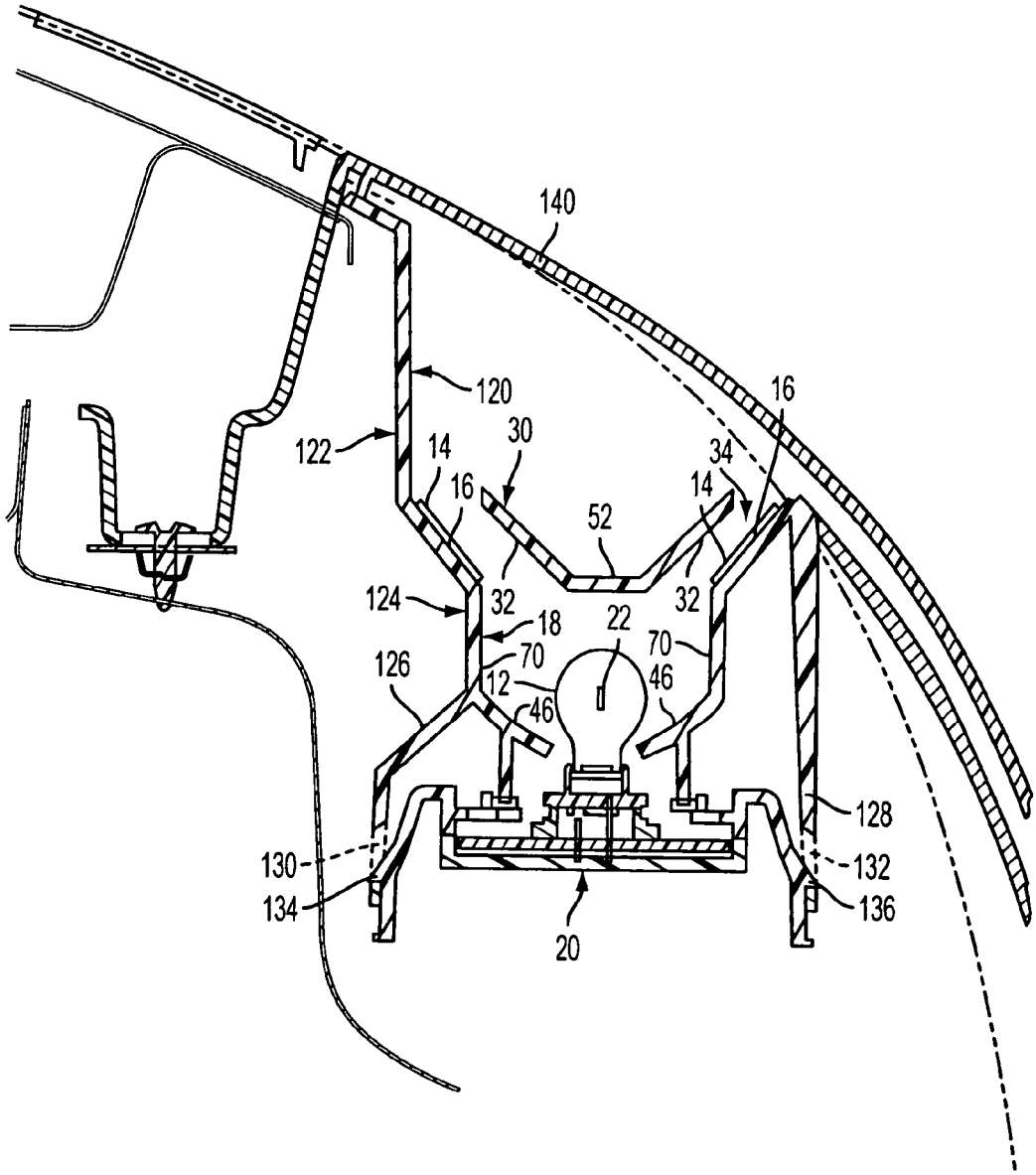
FIG. 5 is a top elevation of a lamp assembly, such as a rear lamp assembly or a front lamp assembly, which includes an illuminated display according to the principles of the present invention.

Referring now to FIG. 5 there is shown a portion 120 of a lamp assembly 122 on an automotive vehicle. The assembly 122 may be a front or rear lamp assembly and includes a support 124 of which the illuminated display 10 is an integral or unitary portion. The support 124 may be fixed to automotive vehicle framing, body panel structure or substructure in accordance with current practice. In the illustrated embodiment the support arrangement 124 includes depending flanges 126 and 128 with apertures 130 and 132 which receive spring arm-type detents 134 and 136 to retain the lamp base 20 in place within the lamp assembly 122. The entire lamp assembly 122 is covered by a lens 140 made of a material such as a polycarbonate material, for example LEXON®.

In the illustrated embodiment of FIG. 5, the illuminated display 10 is preferably a taillight, a brake light, a back-up and stop light or a park/turn signal light in a rear lamp assembly 122. The light emitted by the illuminated display may be red or amber and displays the image 14 whenever illuminated by the bulb 12. While the illuminated display 10 is shown incorporated in a rear lamp assembly 122, the lamp assembly in another context is a front lamp assembly and the illuminated display may be configured as a daytime running light, a parking light or a turn signal light. The illuminated display 10 can also be located at other locations on or in an automotive vehicle, such as but not limited to, rear panels on the trunk or below the trunk or at various locations within the passenger compartment.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. An illuminated display comprising:

a light source for emitting light waves;

a first optical element positioned adjacent to the light source;

at least a first reflective surface on the first optical element, the first reflective surface having an image thereon for reflecting and absorbing components of the light waves from the light source which illuminate the image;

a second optical element positioned adjacent to the light source, the second optical element being spaced from the first optical element to define a gap therebetween, through which gap the image is visible; and at least a second reflective surface, the second reflective surface being on the second optical element and being positioned to reflect light waves from the light source onto the image on the first reflective surface.

2. The illuminated display of claim 1 wherein the first optical element includes a third reflective surface which reflects light waves from the light source to the second reflective surface which in turn reflects the light waves onto the image on the first reflective surface.

3. The illuminated display of claim 2 wherein the second optical element has an aperture therethrough which passes light waves.

4. The illuminated display of claim 3 wherein the aperture is centered with respect to the image on the first reflective surface.

5. The illuminated display of claim 4 wherein the first, second and third reflective surfaces are concentric.

6. The illuminated display of claim 5 wherein at least the second reflective surface has a parabolic shape.

7. The illuminated display of claim 6 wherein the light source is an incandescent bulb, a light emitting diode, an optical fiber or a fluorescent bulb.

8. The illuminated display of claim 7 wherein the optical elements are square, rectangular, circular or oval.

9. The illuminated display of claim 5 wherein the optical elements are square, rectangular, circular or oval.

10. The illuminated display of claim 3 wherein the optical elements are square, rectangular, circular or oval.

11. The illuminated display of claim 1 wherein the optical elements are square, rectangular, circular or oval.

12. The illuminated display of claim 3 wherein the light display includes a mounting arrangement for mounting the light display on an automotive vehicle.

13. The illuminated display of claim 12 wherein the illuminated display is incorporated in a rear signal lamp assembly of the automotive vehicle.

14. The illuminated display of claim 12 wherein the illuminated display is a taillight, a turn signal light, a brake light, a back-up and stop light or a parking light.

15. The illuminated display of claim 12 wherein the illuminated display is incorporated in a front signal lamp assembly.

16. The illuminated display of claim 15 wherein the illuminated display is a turn signal light, a parking light or a daytime running light.

* * * * *